United States Patent [19]

Miller, Jr.

[11] 3,992,824

[45] Nov. 23, 1976

[54] SHOPPING MALL

[75] Inventor: Kenneth C. Miller, Jr., Ruxton, Md.

[73] Assignee: Monumental Properties Inc., Baltimore, Md.

[22] Filed: Mar. 22, 1973

[21] Appl. No.: 343,655

[52] U.S. Cl. ..... 52/29; 52/174; 52/185; 52/236

[51] Int. Cl.[2] ..... E04H 3/02

[58] Field of Search ..... 52/175, 185, 174, 31, 52/29, 236

[56] References Cited

OTHER PUBLICATIONS

Architectural Record, Apr. 1966, pp. 52, 149–170.

*Primary Examiner*—John E. Murtagh

*Attorney, Agent, or Firm*—Cushman, Darby & Cushman

[57] ABSTRACT

A two-level mall of shops is so sited that an approach is made approximately midway between the two levels. Preferably anchor stores are located at both ends of the mall and across from the central entrance. Mall shops are entered by moving up or down a half-level from the entrance to even out the advantage of "main" floor shops. At the ends of the mall, a level change is so encouraged by the layout that shoppers who walk down the length of the mall at one level will likely walk back along the other level. The middle specialty store and mall shops may be multiple level and thus gain advantage of supplemented potential for attracting passing trade.

8 Claims, 7 Drawing Figures

SHOPPING MALL

BACKGROUND OF THE INVENTION

In the last four decades, shopping centers have become more prevalent as ways and means for selling. A more recent elaboration is the siting of such centers so as to include rows of shops which face one another across an acrade, closed walkway or mall. Such centers are becoming known as shopping malls. Beside retail sales stores, tenants of units in such malls include such diverse operations as restaurants, banks, movie theaters, coin laundries, public libraries, light manufacturing facilities, local governmental offices, community agencies, data processing offices, and real estate agencies. References to "stores" and "customers", etc. herein should be taken to include the comparable terms for all mall uses.

In order to site more mall selling space in less space on the ground, some shopping malls have been built on more than one level. However, one level of, for instance, a conventional two-level mall is generally so sited that it is more easily approached from the street; that predisposes a greater traffic density for one level of the mall than the other and makes merchants less desirous of being located on one level than the other. That adversely affects the potential profitability of a mall from its owner's viewpoint. Tenants of multiple-level stores in such conventional two-level malls are faced with how to keep their "front door" sales displays on the malls' secondary level from presenting too "low fashion" an appearance to be compatible with the store's intended image, or in "wasting" some of their best displays in a relatively low traffic region.

The invention grew out of a study aimed to equalize advantages of various tenants of a multiple-level commercial mall to be built so as to integrate therewith, as an anchor store, a new department store having an entrance at grade in such a manner as to avoid need for substantial modification of that preexisting store.

SUMMARY OF THE INVENTION

In its presently most preferred form, the invention provides a mall having shops on two levels, having an an anchor store at each end and a large specialty store across from the mall central entrance. The mall central entrance is at a level midway between the two shopping levels and means for transferring level are so sited and balanced that shoppers are initially about equally likely to transfer to and shop along either level and are likely to change levels at each end of the mall. In the preferred embodiment the middle specialty store has entrances at both levels and the anchor stores are entered by transferring a half-level up or down, depending on the level transferred from. Separate grade level entrances may be provided for the anchor stores.

Shoppers may transfer between levels and from the access mid-level via stairs, ramps, escalators, etc., generically termed "level transfer means".

The principles of the invention will be further hereinafter discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
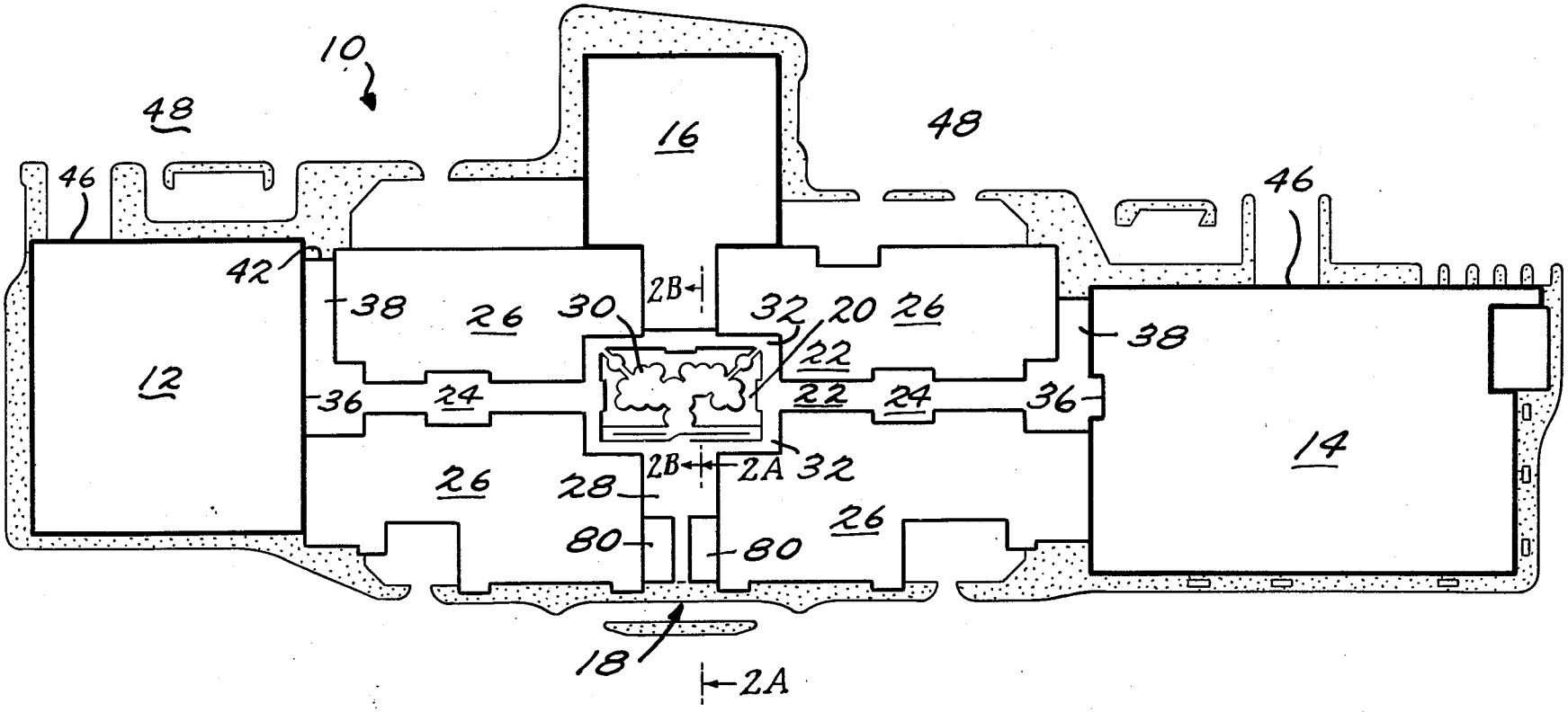
FIG. 1 is a top plan diagrammatic view of the presently preferred embodiment of the shopping mall, with roof areas removed to expose entrance level details.
Figure 2A:
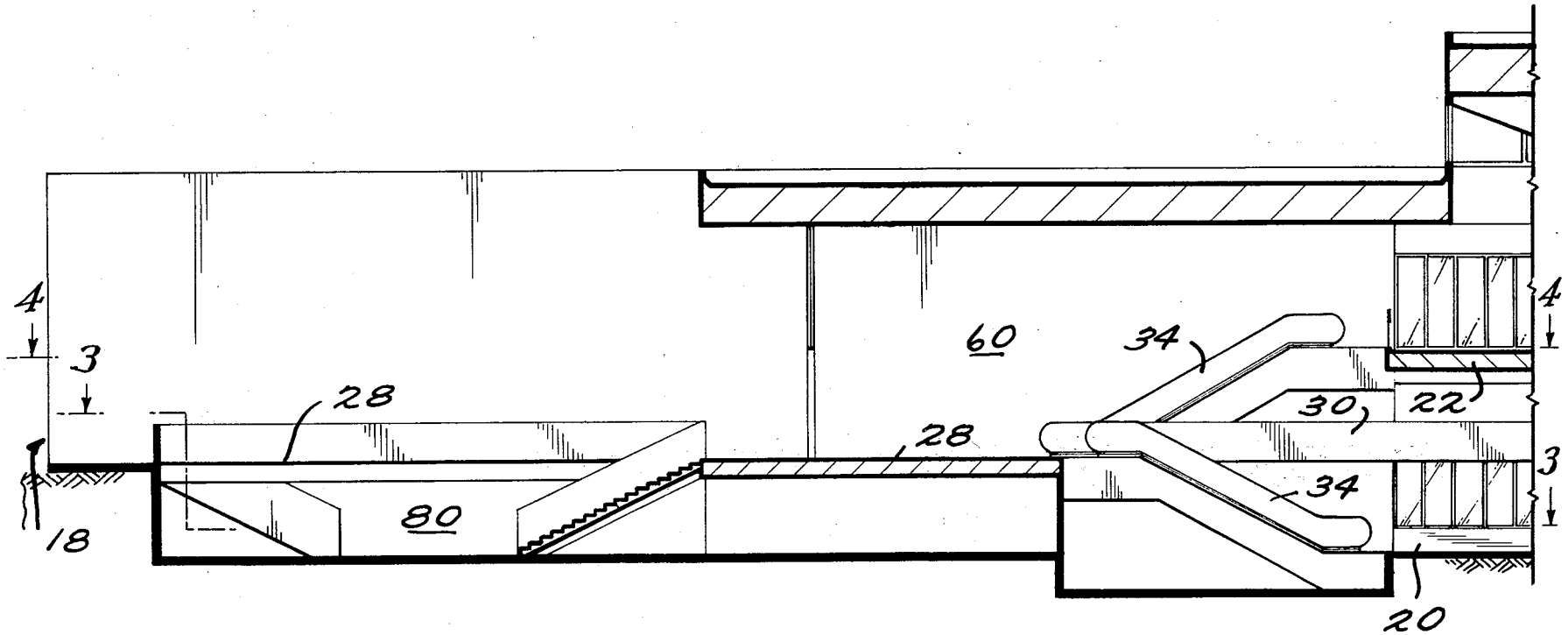
FIGS. 2A and 2B are vertical sectional views taken along the lines 2A—2A and 2B—2B of FIG. 1.
Figure 2B:
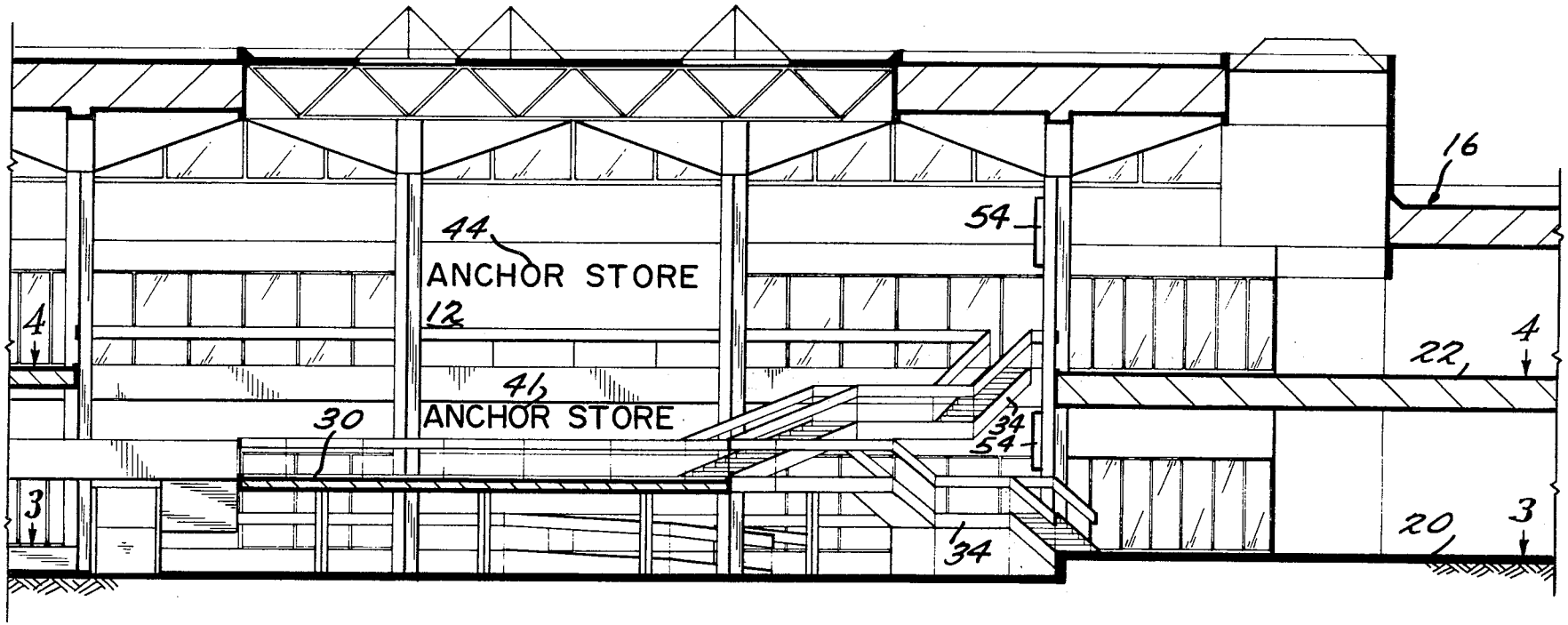
Figure 3:
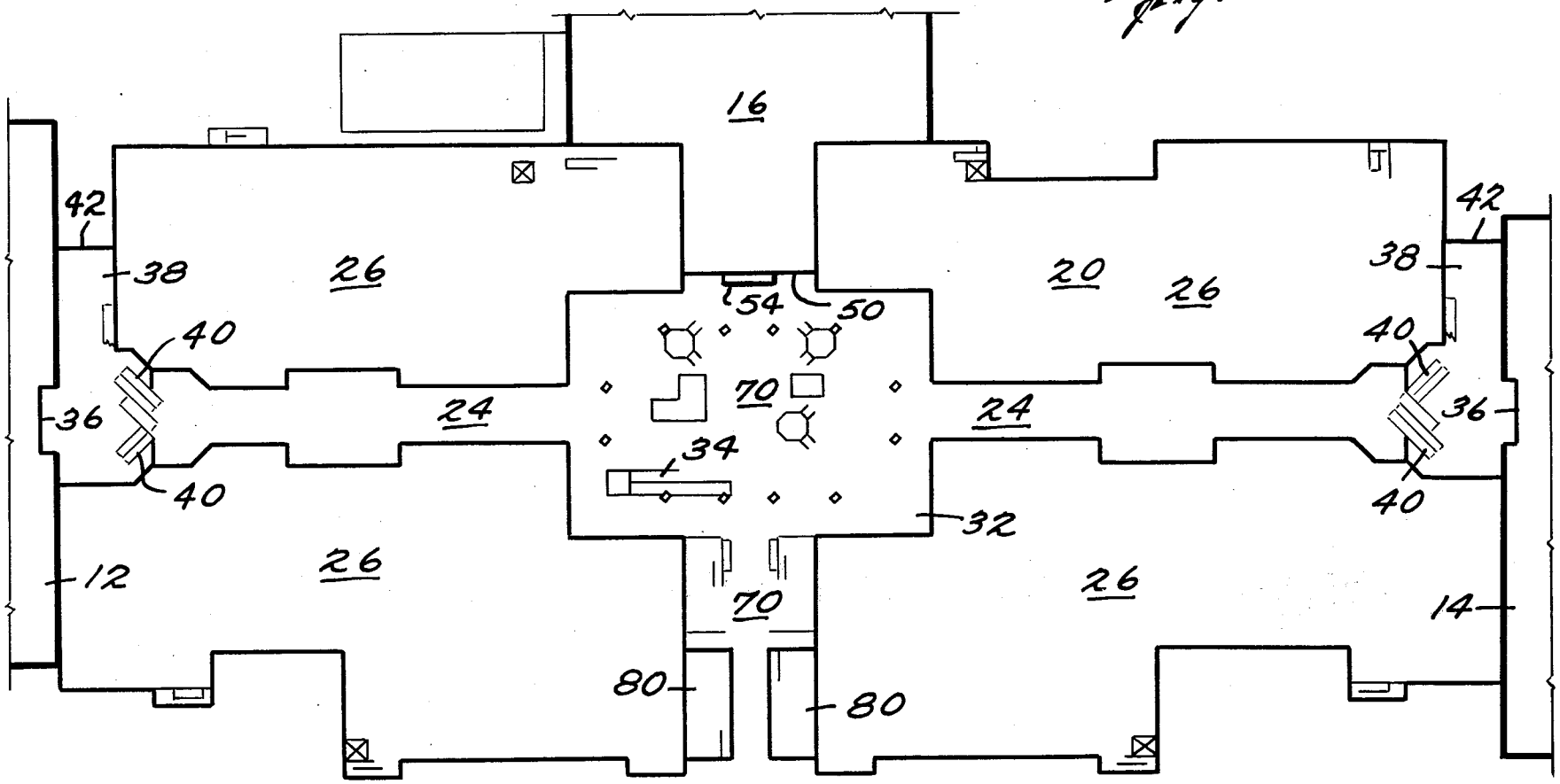
FIG. 3 is a diagrammatic plan view of the central portion of the lower level of the mall, the end anchor and middle specialty stores being partly broken away to permit the remainder to be shown on a larger scale.
Figure 4:
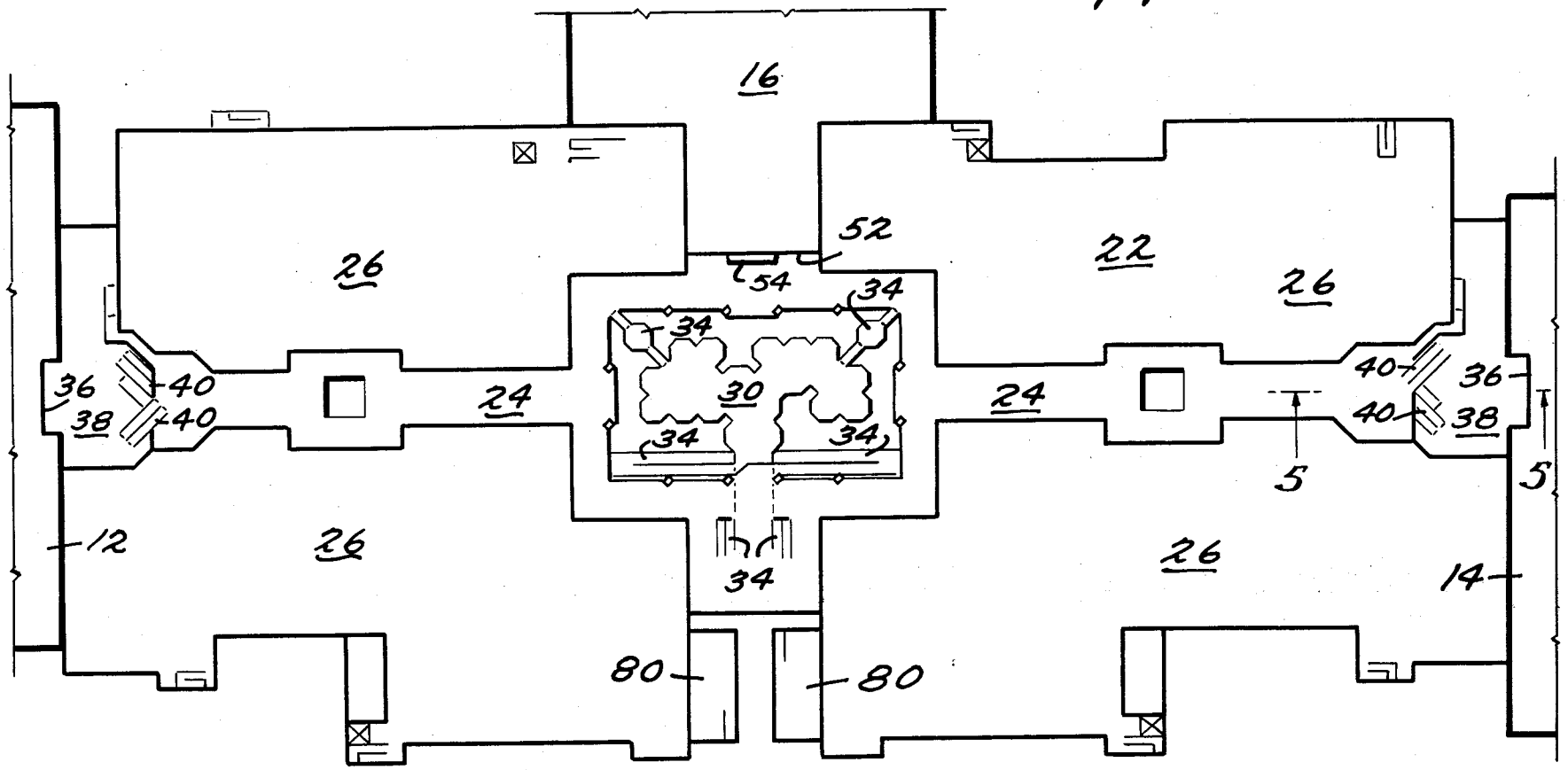
FIG. 4 is a diagrammatic plan view comparable to FIG. 3, but of the upper level of the mall.
Figure 5:
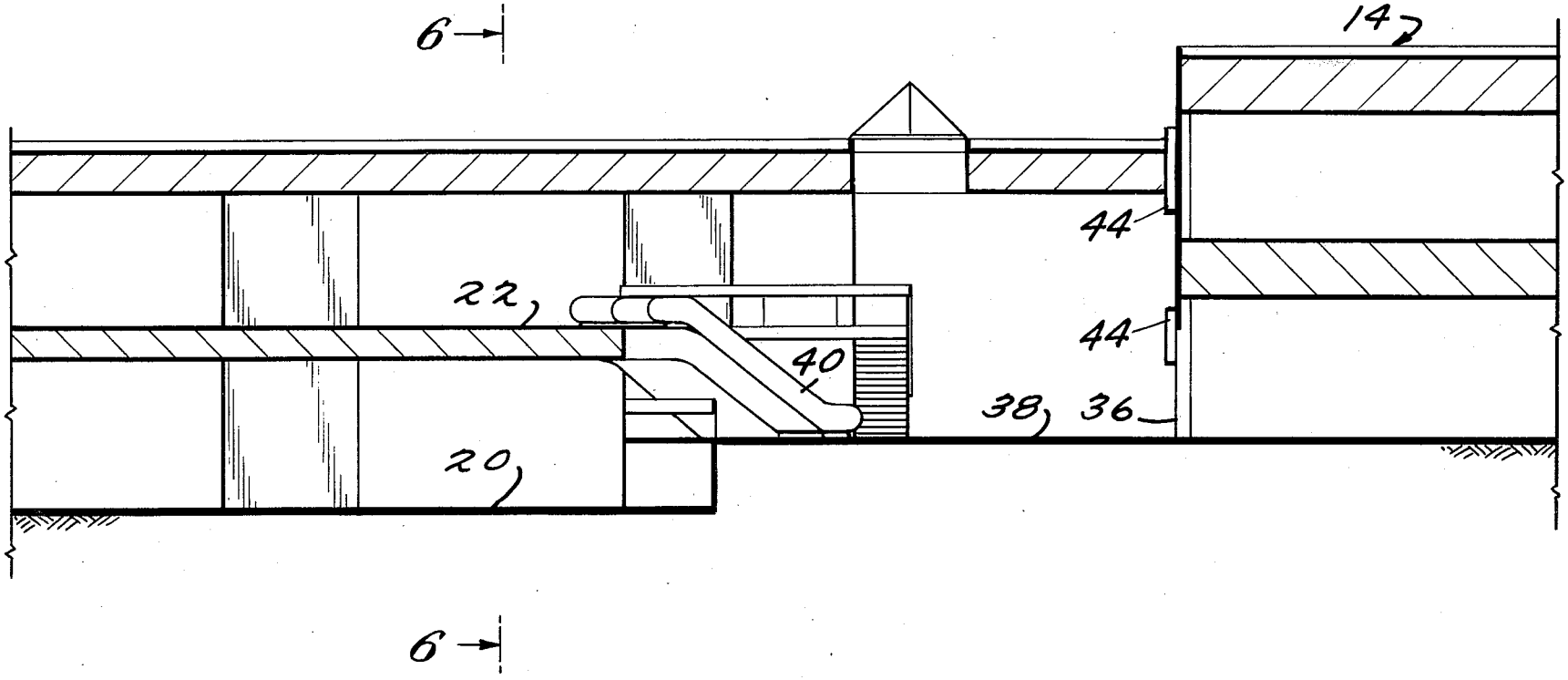
FIG. 5 is a fragmentary vertical sectional view taken along the line 5—5 of FIG. 4.
Figure 6:
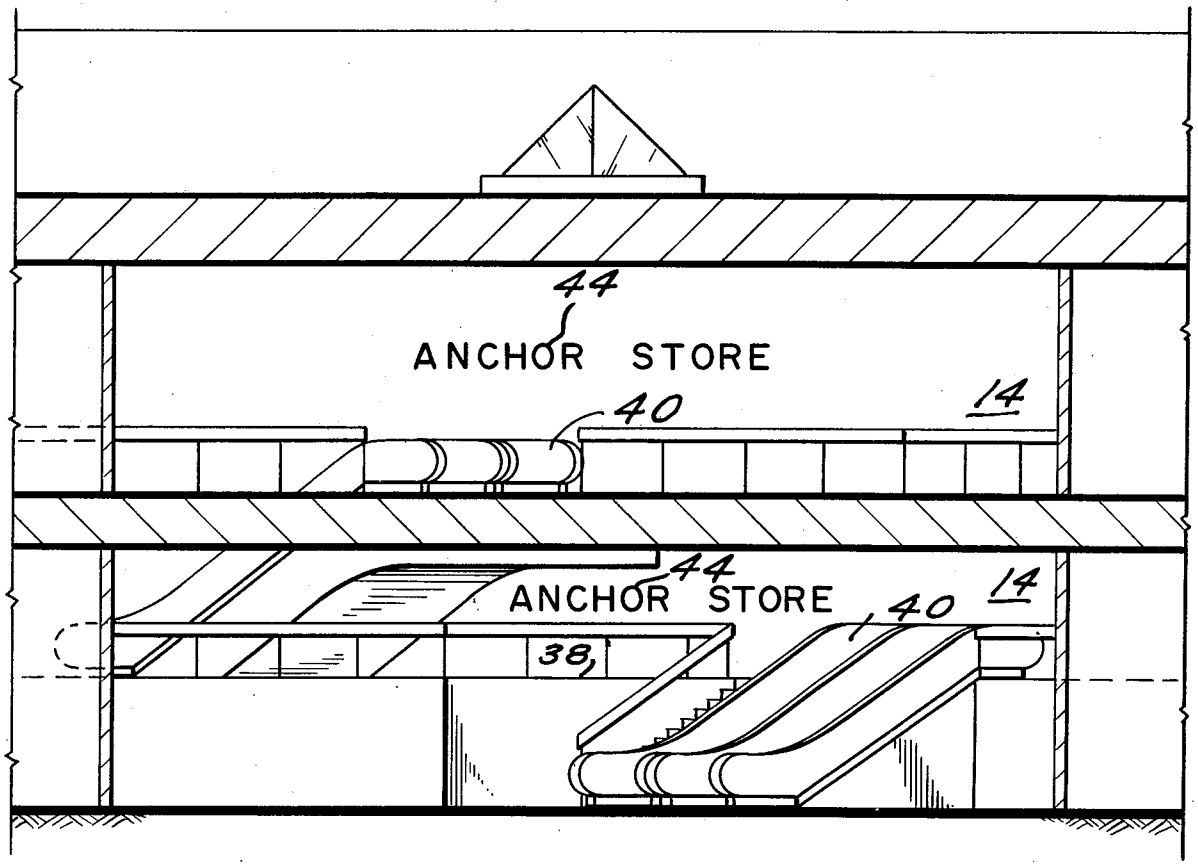
FIG. 6 is a fragmentary vertical sectional view taken along the line 6—6 of FIG. 5.

The shopping mall 10 includes an anchor store 12, 14 at each end and a large specialty store 16 across from the main entrance 18 intermediate the ends of the mall. Two levels 20, 22 of enclosed space join the stores 12, 14, 16. A covered walkway 24 is provided on each level between facing mall store sites 26.

By preference, the lower level 20 is recessed into the ground by about half its height.

Primary access to and from the mall is via the main entrance 18 which comprises a walkway 28 extending into the shopping mall 10 from grade onto a platform 30 so situated that the walkways 24 of the upper and lower levels 22, 20 intersect it and ring it at 32.

Because of the preferred disposition of the levels 20, 22 relative to grade, the platform 30 is disposed at a mid-level about half-way between the levels 20 and 22. Level transfer means 34 provided between the platform 30 and both of the shopping levels to equalize the liklihood entering shoppers will descend to the lower shopping levels 20 or ascend to the upper shopping level 22.

By preference, the anchor stores 12, 14 at each end of the mall have mall entrances 36 disposed at the same mid-level as the platform 30. Accordingly, these entrances 36 each include an access platform 38 reached from either level 20, 22 by level transfer means 40 extending between the mall walkways 24 at these two levels and the respective access platforms 38. The access platforms 38 are shown spreading across the full width of the juncture of the respective anchor stores 12, 14 with the mall, so that additional grade level access to the shopping mall 10 is provided at the ends 42 of the platforms 38. These platforms also serve to set the anchor stores back from the mall stores on both levels to thereby provide room for more mall-facing display windows for the anchor store and this layout permits the mall-facing signs 44 of the anchor stores to be viewed from the walkways 24 on both levels and from the main entrance access platform 30.

The anchor stores 12, 14 may also have additional entrances 46 at grade opening toward the parking areas 48 preferably ringing the shopping mall on several sides.

The path of most logical opportunity for a shopper who has entered the mall and transferred to one shopping level is to change levels to reach an access platform 38 once reaching an end of the particular walkway 24. After encountering the anchor store 12 or 14 reachable from that access platform, the shopper is likely to transfer to the other shopping level for the walk back.

By preference, the large specialty store 16 located across from the main entrance 18 has two entrances 50, 52 correspondingly at each of the levels 20, 22. These are shown communicating with the walkways 24 where they ring the platform 30 at 32. Thus, shoppers walking may be deflected by the rings 32 toward entering the large specialty store 16. Shoppers entering the mall via the mid-level platform 30 face this specialty store and are directly confronted by its main mall-facing sign 54 and display windows. These shoppers may use the level transfer means 34 to reach the entrances 50 and 52.

It should now be apparent that the invention provides a two-level shopping mall with a substantial equality of sales potential from the two levels and that the mall of the invention may be built next to a preexisting anchor store 12 or 14 having a grade level entrance so as to incorporate that store into the mall as is.

The invention contemplates in its most preferred form that the access mid-level platforms 30, 38 will be used solely for access, displays and inviting decoration, but not for sales except within the anchor stores 12, 14.

Typically, shoppers who have entered through the main entrance at 18 find themselves in a generously-sized, high ceilinged lobby or court 60 from which a number of attractions beckon, most notably:

1. The mall-facing storefront and sign 54 of the large specialty store 16, obviously reachable by walking ahead to the level transfer means 34.

2. The upper mall level 22 which appears as a balcony, reachable by using the "up" level transfer means 34.

3. The store fronts of the lower level 20 mall stores, reachable by using the "down" level transfer means 34.

By judicious relative sizing, disposition and baffling of the approaches and level transfer means, a reasonably even splitting of shoppers into segments following each of these opportunities can be provided.

Also typically, shoppers who have entered through a grade level entrance 42 onto an access platform 38 next to an anchor store 12 or 14 are confronted with opportunities to:

1. Enter that anchor store through its mall entrance 36 directly from the access platform.

2. Ascend to the upper mall level via the "up" level transfer means 40.

3. Descend to the lower mall level via the "down" level transfer means 40.

An illustration of the way judicious design can combine with human nature to even out the split of how many shoppers will take each of paths (2) and (3) is to dispose the "up" escalator further from the entering shoppers than the "down" stairs to make the mode of level transfer that calls for more effort easier to reach than the mode that calls for less effort.

The space 70 below the lobby can be used to house house-keeping functions such as the business office of the mall shopping center, thus providing a central location while freeing other space to be leased.

Typical stores for the anchor stores and large specialty store are outlets of national and regional retailing chains dealing in clothes and general merchandise. The square footage of these stores and their size relative to others of the stores in the mall are variable without departing from the principles of the invention. Other stores in the complex may have entrances on both levels 20, 22. Inside such stores additional level transfer devices may be included. Various elaborations may also be included, such as having the walkway at the main entrance cross over a sunken court 80, bridge-fashion, to reach the platform 30. The sunken court may be open to the sky and have one or more stores open directly onto the court. Other traditional features can be incorporated into the complex, such as parking structure. Variations of the basic design may be provided, such as another main entrance at grade intermediate the ends of the mall, spaced from and replicating the entrance 18, and having another large specialty store opposite it. The main walkways 24 may branch to provide lower density traffic regions suitable for doctor's offices, religious reading rooms, law offices and the like.

It should now be apparent that the shopping mall as described hereinabove possesses each of the attributes set forth in the specification under the heading "Summary of the Invention" hereinbefore. Because the shopping mall of the invention can be modified to some extent without departing from the principles of the invention as they have been outlined and explained in this specification, the present invention should be understood as encompassing all such modifications as are within the spirit and scope of the following claims.

What is claimed is:

1. A shopping mall, comprising:

a first double row of stores facing one another across a first walkway at a first, lower level;

a second double row of stores overlying the first and facing one another across a second walkway at a second, upper level;

means providing access to the shopping mall and including path means extending from grade to intrusion into the first and second double rows at a level intermediate said first level and said second level, this path means including an access platform within the shopping mall at the intermediate level;

level transfer means extending from said access platform to the first level and to the second level for communicating the access platform with the respective first and second walkways;

an anchor store at one end of said first and second double rows of stores;

means defining a second platform at a level intermediate the first and second levels between the anchor store and the first and second walkways;

means defining an entrance to the anchor store communicating with the second access platform;

level transfer means extending from the second access platform to the first level and to the second level for communicating the second access platform with the first and second walkways;

another anchor store at the other end of said first and second double rows of stores;

means defining a third access platform at a level intermediate the first and second levels between the other anchor store and the first and second walkways;

means defining an entrance to the other anchor store communicating with the third access platform;

and level transfer means extending from the third access platform to the first level and to the second level for communicating the third access platform with the first and second walkways.

2. The shopping mall of claim 1, further comprising:

means providing additional access to the shopping mall and including path means extending from grade to the second access platform.

3. The shopping mall of claim 1, further comprising:

means providing additional access to the shopping mall and including path means extending from grade to the third access platform.

4. The shopping mall of claim 1, wherein at least one store of said first double row of stores is at least two levels in height, respectively generally corresponding to said first level and said second level;

means defining a first entrance to said one store from said first level, communicating said one store with said first walkway;

and means defining a second entrance to said one store from said second level, communicating said one store with said second walkway.

5. The shopping mall of claim 4, wherein said at least one store lies across said first and second walkways from the first-described access platform and wherein at least one of the level changing means extending from the first-described access platform is directed generally toward said one store to facilitate directing shoppers to that one store.

6. The shopping mall of claim 4, wherein the second walkway at least mostly encircles the first-described access platform and the second level is cut away within such encirclement to provide a two level high entrance lobby containing the first-described access platform.

7. The shopping mall of claim 1 disposed on a generally flat site, wherein said second level is disposed about one-half story below grade and said path means extends substantially at grade from outside the shopping mall to the first-described access platform.

8. The shopping mall of claim 1 wherein the last-recited level transfer means includes an escalator proceeding from the first level to the second level to free the choice of changing from the first, lower level to the second, upper level at said one end of the mall, of the necessity for deciding whether to expend effort in climbing stairs.

* * * * *